US009334768B1

(12) United States Patent
Gould

(10) Patent No.: US 9,334,768 B1
(45) Date of Patent: May 10, 2016

(54) OIL DRAIN FUNNEL AND PAN

(71) Applicant: Douglas M. Gould, Bailey, CO (US)

(72) Inventor: Douglas M. Gould, Bailey, CO (US)

( * ) Notice: Subject to any disclaimer, the term of this patent is extended or adjusted under 35 U.S.C. 154(b) by 71 days.

(21) Appl. No.: 14/331,309

(22) Filed: Jul. 15, 2014

(51) Int. Cl.
*F01M 11/04* (2006.01)
*B67C 11/02* (2006.01)

(52) U.S. Cl.
CPC ..... *F01M 11/0458* (2013.01); *B67C 11/02* (2013.01); *B67C 2011/022* (2013.01)

(58) Field of Classification Search
CPC .. B67C 11/00; B67C 11/02; B67C 2011/022; B67C 2011/025; F01M 11/04
USPC ..... 141/337, 338; 137/312–314
See application file for complete search history.

(56) References Cited

U.S. PATENT DOCUMENTS 1,461,654 A 7/1923 Haessler
4,098,398 A * 7/1978 Meyers ..... B65D 5/46 141/340
4,286,634 A * 9/1981 Wisner ..... B65B 39/02 141/338
4,485,853 A 12/1984 Gunderson
5,082,035 A * 1/1992 Maxwell ..... F16N 31/002 141/331
5,121,776 A 6/1992 Kovach
5,301,724 A * 4/1994 Maxwell ..... F16N 31/002 141/297
5,360,039 A * 11/1994 Verrilli ..... F16N 31/004 141/331
5,379,862 A * 1/1995 Schmidt ..... F16N 31/002 141/98
5,803,140 A 9/1998 Jodoin
5,975,156 A * 11/1999 Senour ..... B67C 11/02 141/331
7,014,074 B1 * 3/2006 Rinaldi ..... B65D 25/44 141/337
7,225,841 B2 6/2007 Folk
7,322,386 B2 1/2008 Holm
D663,592 S 7/2012 Bridges
2008/0054004 A1 3/2008 Dudzinski

FOREIGN PATENT DOCUMENTS

CN 102556919 7/2012
EP 1680351 9/2015

* cited by examiner

*Primary Examiner* — Timothy L Maust
(74) *Attorney, Agent, or Firm* — Kyle A. Fletcher, Esq.

(57) ABSTRACT

The fluid collection assembly includes a pan that may be positioned beneath a vehicle. A funnel is coupled to the pan. The funnel is positionable between an extended position and a collapsed position. The funnel collects the fluid. The fluid is directed into the pan.

10 Claims, 5 Drawing Sheets

OIL DRAIN FUNNEL AND PAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of funnels and pans, more specifically, oil drain funnels and pans.

SUMMARY OF THE INVENTION

An embodiment of the disclosure meets the needs presented above by generally comprising a pan that may be positioned beneath a vehicle. A funnel is coupled to the pan. The funnel is positionable between an extended position and a collapsed position. The funnel collects the fluid. The fluid is directed into the pan.

An object of the invention is to provide a device that is oil drain funnel and pan.

These together with additional objects, features and advantages of the oil drain funnel and pan will be readily apparent to those of ordinary skill in the art upon reading the nonetheless illustrative, embodiments of the oil drain funnel and pan when taken in conjunction with the accompanying drawings.

In this respect, before explaining the current embodiments of the oil drain funnel and pan in detail, it is to be understood that the oil drain funnel and pan is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of oil drain funnel and pan.

It is therefore important that the claims be regarded as including such equivalent construction insofar as they do not depart from the spirit and scope of oil drain funnel and pan. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
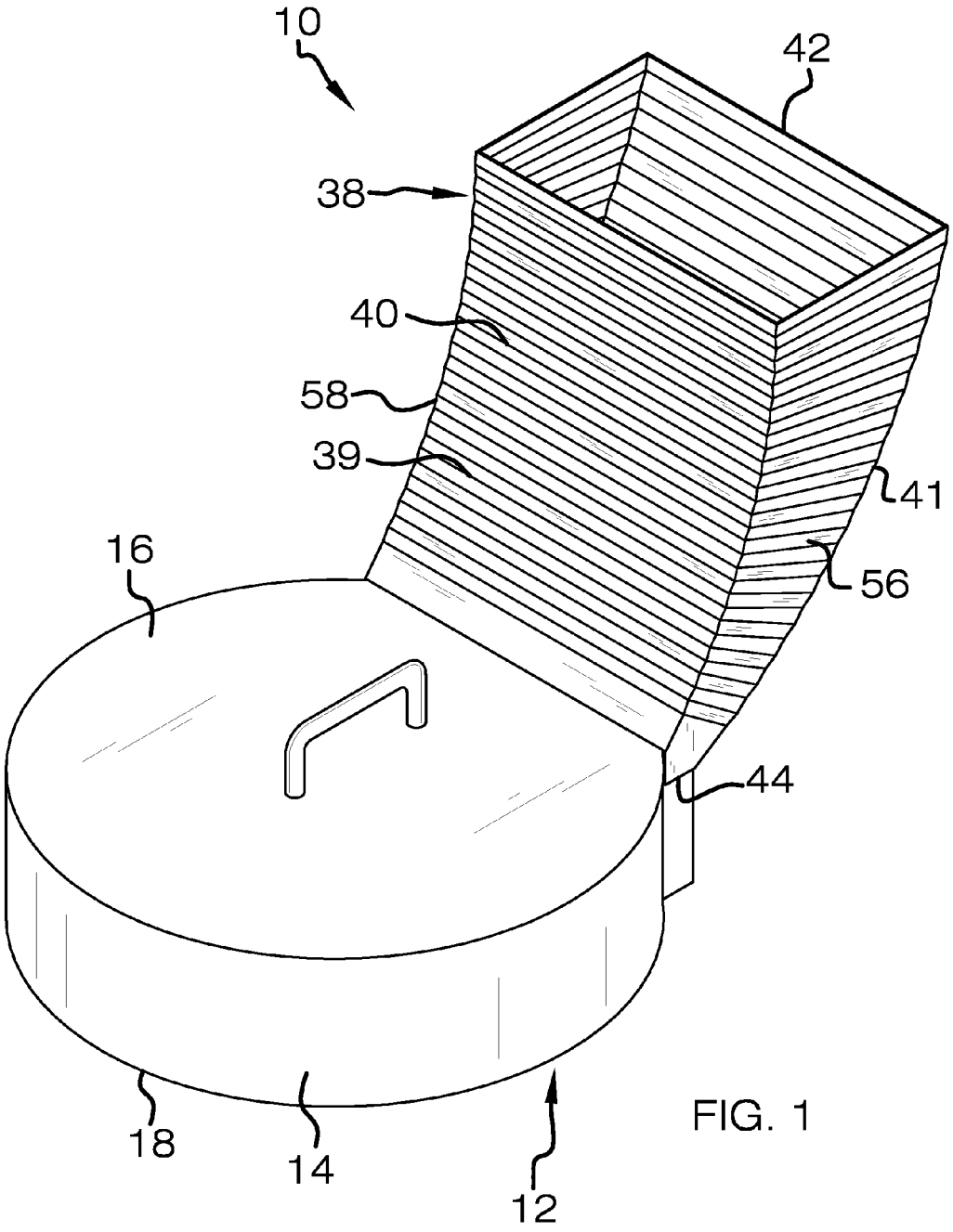
FIG. 1 is a perspective view of a fluid collection assembly according to an embodiment of the disclosure.
Figure 2:
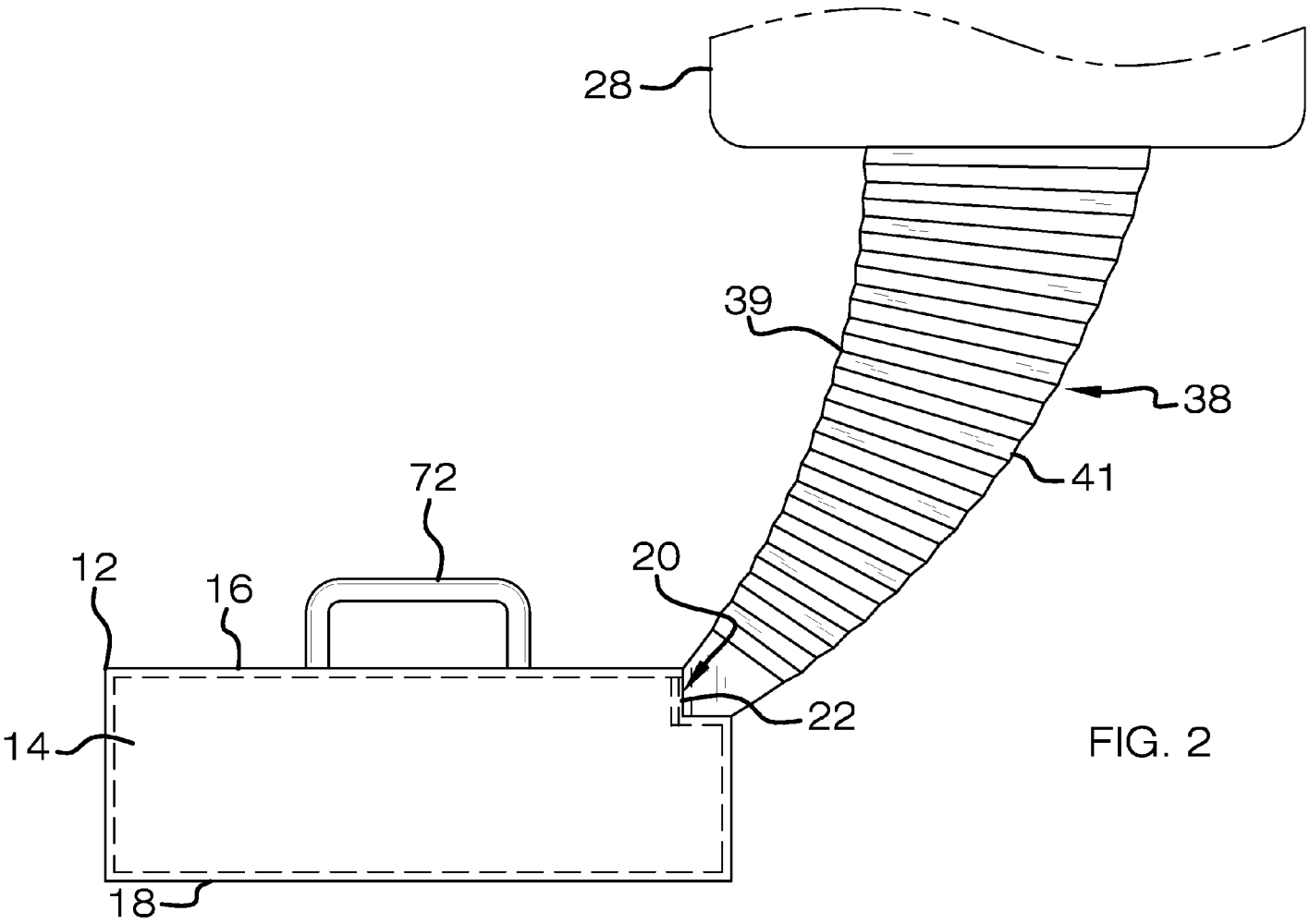
FIG. 2 is a left side view of an embodiment of the disclosure.
Figure 3:
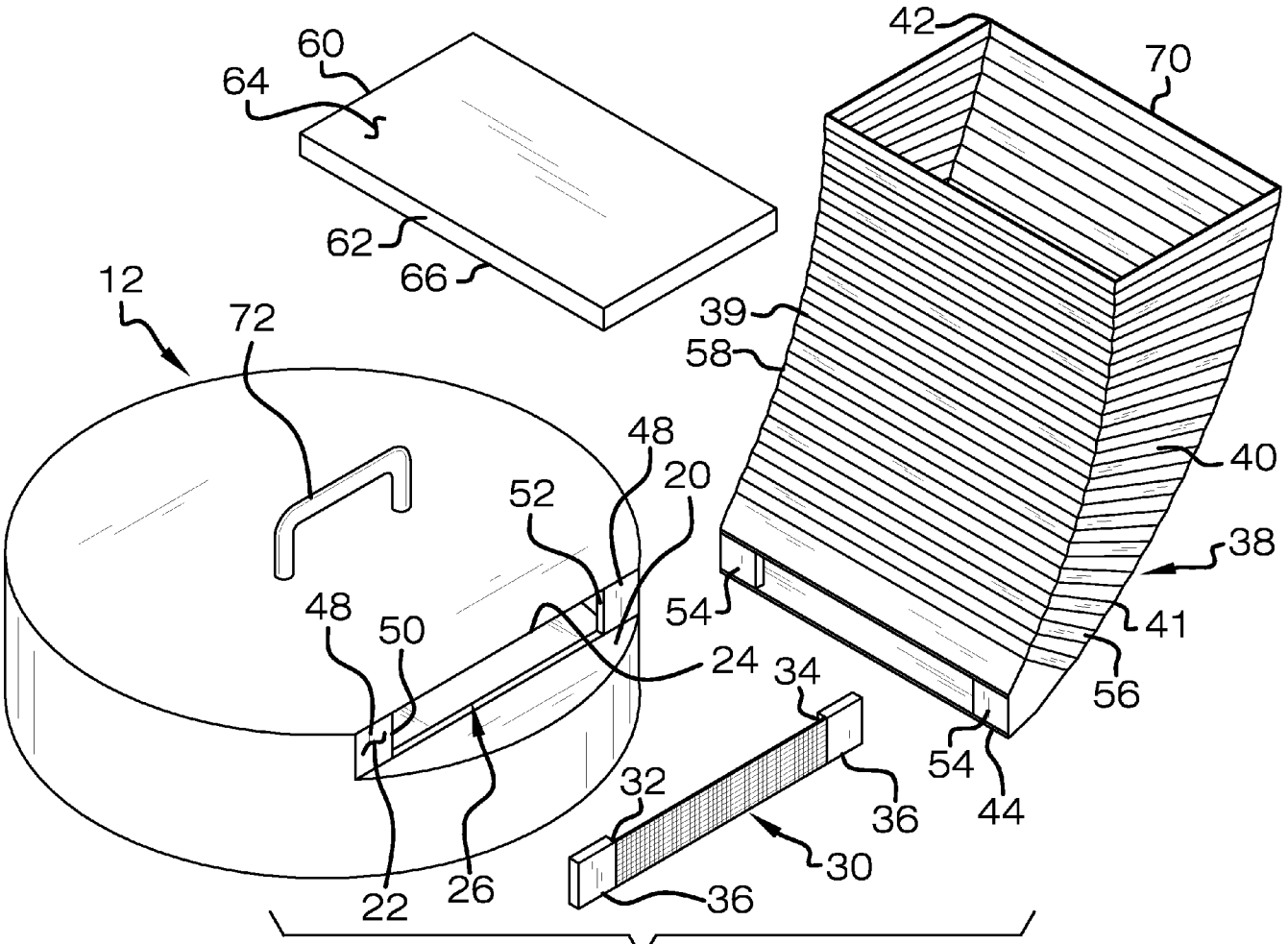
FIG. 3 is a top perspective view of an embodiment of the disclosure.
Figure 4:
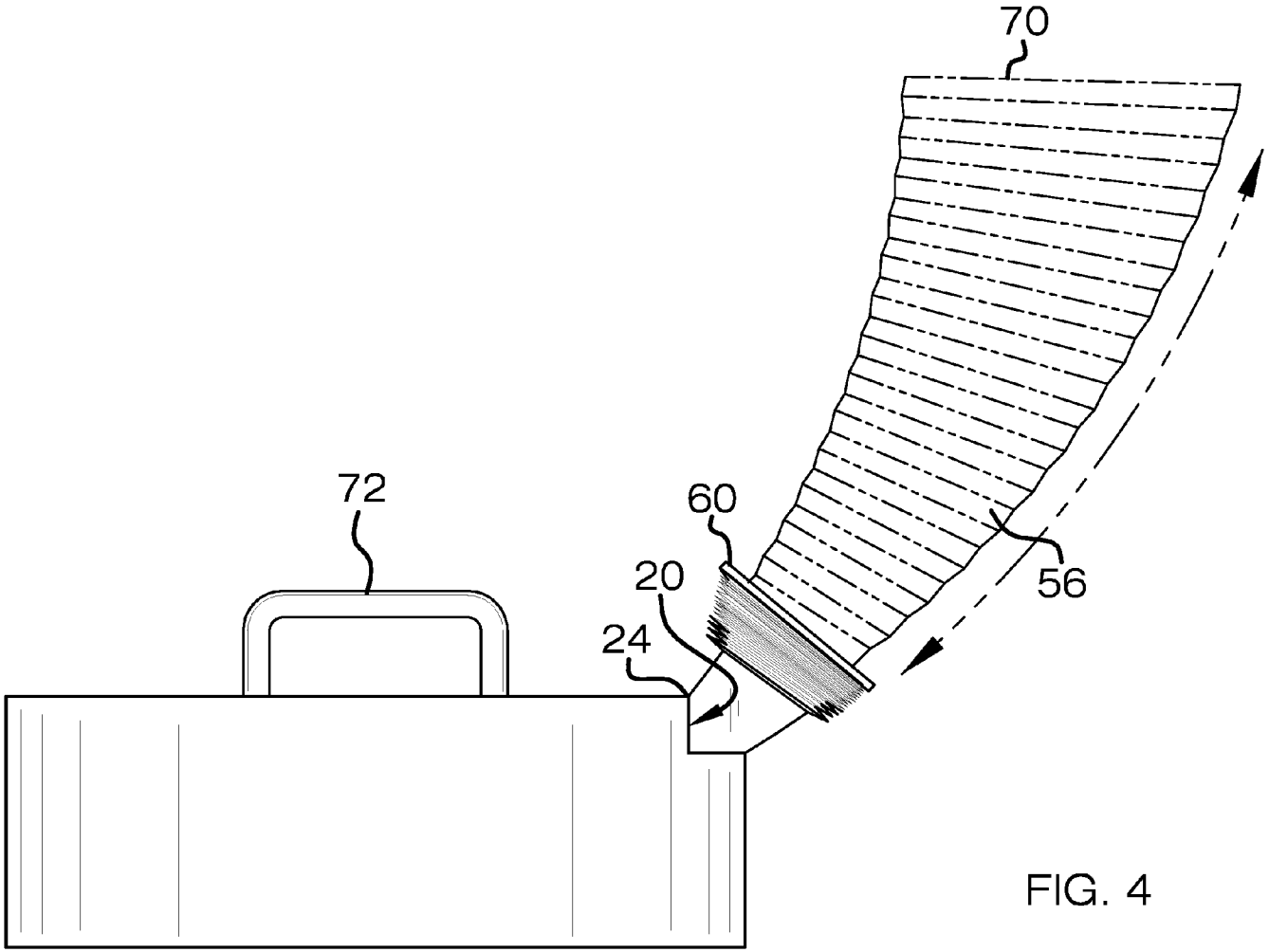
FIG. 4 is a left side perspective view of an embodiment of the disclosure.
Figure 5:
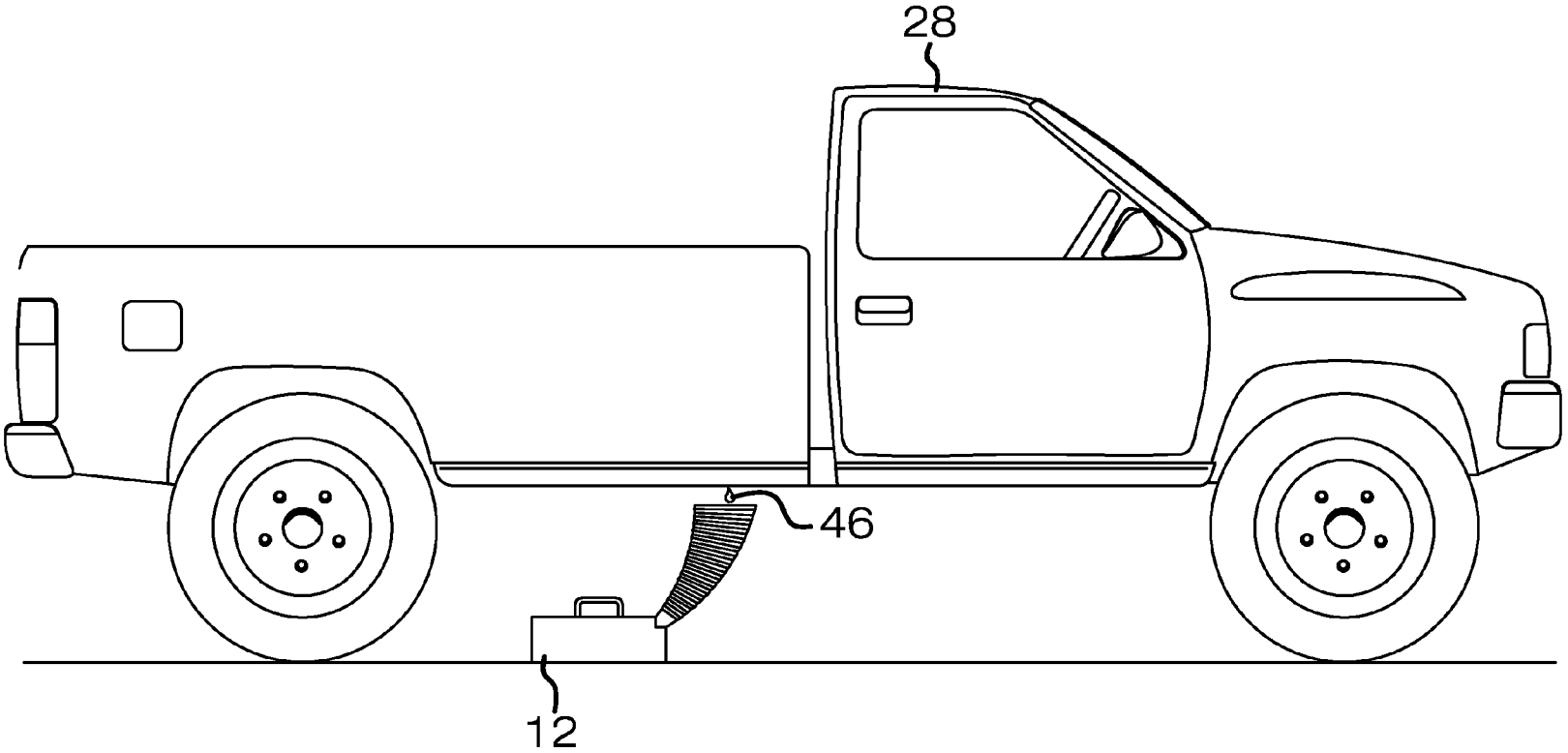
FIG. 5 is an in-use view of an embodiment of the disclosure.

As best illustrated in FIGS. 1 through 5, the fluid collection assembly 10 generally comprises a pan 12. The pan 12 has an outer wall 14 extending between a top wall 16 and a bottom wall 18 of the pan 12. Additionally, the outer wall 14 of the pan 12 is curved. The pan 12 has a circular shape.

The outer wall 14 of the pan 12 has a collection groove 20 extending therein. A front surface 22 of a bounding edge 24 of the collection groove 20 has a collection opening 26 extending therethrough to access an interior of the pan 12. The pan 12 may be positioned beneath a vehicle 28. The vehicle 28 may be a passenger vehicle of any conventional design.

A screen 30 has a first end 32 and a second end 34. The screen 30 is elongated. A pair of plates 36 is each coupled to an associated one of the first 32 and second 34 ends of the screen 30.

A funnel 38 is provided. The funnel 38 has an exterior wall 40 extending between a top end 42 and a bottom end 44 of the funnel 38. Each of the top 42 and bottom 44 ends of the funnel 38 is open. The exterior wall 40 of the funnel 38 is pleated. A front side 39 of the exterior wall 40 of the funnel has a length that is less than a back side 41 of the exterior wall 40 of the funnel 38. The funnel 38 has a curved shape.

The funnel 38 is collapsible in the convention of an accordion. Moreover, the funnel 38 is positionable between an extended position and a collapsed position. The funnel 38 collects a fluid 46 such that the fluid 46 is directed into the pan 12. The fluid 46 may be motor oil of any conventional design.

A first pair of couplers 48 positioned within the collection opening 26. Each of the first pair of couplers 48 is positioned proximate an associated one of a first lateral edge 50 and a second lateral edge 52 of the collection opening 26. A second pair of couplers 54 is positioned within the bottom end 44 of the funnel 38. Each of the pair of second couplers 54 is positioned proximate an associated one of a first oblique side 56 and a second oblique side 58 of the exterior wall 40 of the funnel 38. Each of the first 48 and second 54 pairs of couplers may be comprised of a magnetic material.

The screen 30 is positionable within the collection groove 20. Each of the pair of plates 36 on the screen 30 abuts an associated one of the pair of first couplers 48. The bottom end 44 of the funnel 38 is positionable within the collection groove 20. Moreover, the bottom end 44 of the funnel 38 is aligned with the collection opening 26.

Each of the first 48 and second 54 pairs of couplers is complementary. The first 48 and second 54 pairs of couplers retains the funnel 38 on the pan 12 when the bottom end 44 of the funnel 38 is positioned within the collection groove 20. The screen 30 is retained between the bottom end 44 of the funnel 38 and the collection opening 26. The screen 30 prevents particles from entering into the pan 12 when the funnel 38 collects the fluid 46.

A cover 60 is provided. The cover 60 has an extraneous edge 62 extending between an upper surface 64 and a lower surface 66 of the cover 60. Additionally, the cover 60 is positionable on the funnel 38. The lower surface 68 of the cover 60 abuts an upper edge 70 of the top end 42 of the funnel 38. A handle 72 is coupled to a top wall 16 of the pan 12. The handle 72 may be gripped.

In use, the assembly 10 is positioned beneath the vehicle 28 when the fluid 46 is be drained from the vehicle 28. The funnel 38 is positioned in the extended position so the top end 42 of the funnel 38 collects the fluid 46. The cover 60 is positioned over the top end 42 of the funnel 38 after the fluid 46 is drained from the vehicle 28. The assembly 10 prevents the fluid 46 from spilling on the ground. The funnel 38 is removable from the pan 12. The fluid 46 is poured out of the pan 12 when the pan 12 becomes filled with the fluid 46.

With respect to the above description, it is to be realized that the optimum dimensional relationship for the various components of the fluid collection assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the fluid collection assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

I claim:

1. A fluid collection assembly configured to collect the fluid from a vehicle such that the fluid is prevented from spilling, said assembly comprising:

a pan configured to be positioned beneath the vehicle; and a funnel coupled to said pan, said funnel being positionable between an extended position and a collapsed position, said funnel collecting the fluid such that the fluid is directed into said pan;

said pan having an outer wall extending between a top wall and a bottom wall of said pan;

an outer wall of said pan being curved such that said pan has a circular shape;

an outer wall of said pan having a collection groove extending therein;

a front surface of a bounding edge of said collection groove having a collection opening extending therethrough to access an interior of said pan;

a screen having a first end and a second end, said screen being elongated;

said funnel having an exterior wall extending between a top end and a bottom end of said funnel, each of said top and bottom end of said funnel being open;

a first pair of couplers positioned within a collection opening;

a second pair of couplers being positioned within a bottom end of said funnel.

2. The assembly according to claim 1, further comprising a bottom end of said funnel being positionable within a collection groove such that said bottom end of said funnel is aligned with a collection opening.

3. The assembly according to claim 1, further comprising each of a pair of first and second couplers being complementary such that said funnel is retained on said pan when a bottom end of said funnel is positioned within a collection groove.

4. The assembly according to claim 1, further comprising an exterior wall of said funnel being pleated such that said funnel is collapsible in the convention of an accordion.

5. The assembly according to claim 1, further comprising a cover having an extraneous edge extending between an upper surface and a lower surface of said cover.

6. The assembly according to claim 5, further comprising said cover being positionable on said funnel such that a lower surface of said cover abuts an upper edge of a top end of said funnel.

7. The assembly according to claim 1, further comprising a handle coupled to a top wall of said pan such that said handle is configured to be gripped.

8. A fluid collection assembly configured to collect the fluid from a vehicle such that the fluid is prevented from spilling, said assembly comprising:

a pan having an outer wall extending between a top wall and a bottom wall of said pan, said pan being configured to be positioned beneath the vehicle; and a funnel coupled to said pan, said funnel being positionable between an extended position and a collapsed position, said funnel collecting the fluid such that the fluid is directed into said pan;

said outer wall of said pan being curved such that said pan has a circular shape; said outer wall of said pan having a collection groove extending therein; a front surface of a bounding edge of said collection groove having a collection opening extending therethrough to access an interior of said pan;

a screen having a first end and a second end; said screen being elongated; said funnel having an exterior wall extending between a top end and a bottom end of said funnel; each of said top and bottom end of said funnel being open; a first pair of couplers positioned within a collection opening; a second pair of couplers being positioned within a bottom end of said funnel.

9. The assembly according to claim 8, further comprising a bottom end of said funnel being positionable within a collection groove such that said bottom end of said funnel is aligned with a collection opening; each of a pair of first and second couplers being complementary such that said funnel is retained on said pan when said bottom end of said funnel is positioned within said collection groove; an exterior wall of said funnel being pleated such that said funnel is collapsible in the convention of an accordion.

10. The assembly according to claim 8, further comprising a cover having an extraneous edge extending between an upper surface and a lower surface of said cover; said cover being positionable on said funnel such that a lower surface of said cover abuts an upper edge of a top end of said funnel; a handle coupled to a top wall of said pan such that said handle is configured to be gripped.

* * * * *